US010538363B2

(12) United States Patent
Fink et al.

(10) Patent No.: US 10,538,363 B2
(45) Date of Patent: Jan. 21, 2020

(54) CLOSURE UNIT CONSISTING OF COVER AND VESSEL, CLOSURE COVER AND CLOSING METHOD

(71) Applicant: SILGAN HOLDINGS INC., Stamford, CT (US)

(72) Inventors: Robert Fink, Hassloch (DE); Hans-Peter Hein, Suthfeld (DE); Helmut Klemm, Lathen (DE); Andreas Maniera, Neustadt (DE); Ludwig Kramer, Lathen (DE)

(73) Assignee: SILGAN HOLDINGS INC., Stamford, CT (US)

( * ) Notice: Subject to any disclaimer, the term of this patent is extended or adjusted under 35 U.S.C. 154(b) by 978 days.

(21) Appl. No.: 14/902,143

(22) PCT Filed: Jul. 1, 2014

(86) PCT No.: PCT/IB2014/062768
§ 371 (c)(1),
(2) Date: Nov. 11, 2016

(87) PCT Pub. No.: WO2015/001485
PCT Pub. Date: Aug. 1, 2015

(65) Prior Publication Data

US 2017/0050771 A1 Feb. 23, 2017

(30) Foreign Application Priority Data

Jul. 2, 2013 (DE) ..... 10 2013 106 957
Nov. 21, 2013 (DE) ..... 10 2013 112 891
(Continued)

(51) Int. Cl.
*B65D 41/17* (2006.01)

(52) U.S. Cl.
CPC ..... *B65D 41/17* (2013.01)

(58) Field of Classification Search
CPC ..... B65D 41/17; B65D 21/0209
(Continued)

(56) References Cited

U.S. PATENT DOCUMENTS 1,842,429 A 1/1932 Scofield
3,374,601 A 3/1968 White
(Continued)

FOREIGN PATENT DOCUMENTS

CN 101980924 A 2/2011
DE 1607843 3/1972
(Continued)

OTHER PUBLICATIONS

International Search Report dated Oct. 1, 2014 for PCT application No. PCT/IB2014/062768 (English translation).
(Continued)

*Primary Examiner* — Ernesto A Grano
(74) *Attorney, Agent, or Firm* — Greenberg Traurig LLP

(57) ABSTRACT

What is proposed is a closure unit consisting of a glass container (50) with external, circumferentially offset threaded elements (54, 55) on a container neck (52) of the glass container, and a closure cover made of sheet metal, wherein the closure cover (1, 2) has an encircling plastics layer (30; 30*h*, 30*v*) on the inside of the cover. The closure cover is pressed onto the container neck (52) and can be opened with a rotational movement via the threaded elements (54, 55) and a vertical section (30*v*) of the plastics layer. The container neck (52) has a horizontal end surface (52*a*) on which a horizontal section (30*h*) of the plastics layer rests under pressure in a sealing manner. A central region (11) of the closure cover passes with an adjoining, circumferentially oriented transition zone (11*a*, 11*b*, 11*c*) into an axially downwardly projecting skirt section (12) which ends in a roll-up region (21*a*, 21; 22). The plastics
(Continued)

layer (30; 30*h*, 30*v*) is arranged on the inside of the cover in a manner adhering to the transition zone (11*a*, 11*b*, 11*c*) and the skirt section (12). An axial extent ($h_0$) of the skirt section (12) and a radial dimension (b52) of the horizontally oriented end surface (52*a*) of the container neck (52) form a first ratio ($v_1$) which is smaller than three.

11 Claims, 3 Drawing Sheets

(30) Foreign Application Priority Data

Feb. 21, 2014 (DE) ..... 10 2014 102 306
Mar. 27, 2014 (DE) ..... 10 2014 104 344

(58) Field of Classification Search
USPC ..... 215/318
See application file for complete search history.

(56) References Cited

U.S. PATENT DOCUMENTS 3,741,423 A * 6/1973 Acton ..... B65D 41/0457 215/318
4,000,825 A 1/1977 Wesffall
4,452,365 A 6/1984 Ascasibar-Verdejo
4,552,279 A 11/1985 Mueller et al.
4,603,786 A 8/1986 Lecinski, Jr. et al.
4,709,825 A 12/1987 Mumford
4,863,030 A * 9/1989 Bayer ..... B65D 21/0209 206/427
4,989,740 A * 2/1991 Vercillo ..... B65D 41/0457 215/252
5,740,914 A 4/1998 Herzog
7,175,039 B2 * 2/2007 German ..... B65D 41/3423 215/252
8,424,706 B2 * 4/2013 Robertson ..... B65D 41/0442 215/317

FOREIGN PATENT DOCUMENTS

EP 0242419 10/1987
WO 2002094670 A1 11/2002
WO 2010136414 A1 12/2010
WO 2012158937 A1 11/2012

OTHER PUBLICATIONS

Written Opinion dated Jan. 8, 2015 for PCT application No. PCT/IB2014/062768.

* cited by examiner

CLOSURE UNIT CONSISTING OF COVER AND VESSEL, CLOSURE COVER AND CLOSING METHOD

BACKGROUND OF THE INVENTION

1. Field of the Invention

The invention relates to a closure unit (container and closure cover), to a closure (also: closure cover) and to a method for a container (also: vessel) of glass or plastics, consisting of a container with a container neck having external threaded elements, the closure cover being applied by being pressed axially onto the container neck and being released by a screwing procedure. More precisely, this is a press-on/twist-off closure.

2. Description of the Related Art

"Press-on/twist-off" (PT) types of closures have long been known for use on glass or rigid plastics containers. The preferred form of the closure cover comprises a metal shell body with an upper panel and a skirt portion which projects axially (downwards) therefrom. The generally cylindrical upper portion of the skirt has a deformable plastics lining, into which thread pitches are formed upon vertical pressing onto an opening which is provided radially on the outside with threaded segments. The consumer can subsequently remove the closure cap from the body of the container by a usual untwisting movement, cf. in this respect U.S. Pat. No. 4,709,825 (Mumford), abstract, WO-A 2002/094670 (Crown Cork & Seal), reference numerals 20 and 16 as well as the straight axial skirt 28 with a cylindrical shape and U.S. Pat. No. 4,552,279 (Mueller), the abstract therein and PT cover 10 for the threaded portions 13 on the neck 12 of the container.

These closures provide a person skilled in the art with hermetic sealing of containers for packaging and preserving food, in particular baby food. The food can be packaged while it is hot (above 70° C.) and after the container has been closed and the food has cooled down, a vacuum is produced which can make it considerably more difficult for the consumer to untwist the closure cover (the "opening value" as the torque which is to be applied).

The established prior art which has been tried and tested for decades is to configure the axially downwardly projecting skirt portion and the opening of the container to be relatively long axially, thereby ensuring a hermetic seal, and on the other hand the plastics lining (compound) is to be configured such that it satisfies the sealing conditions and can still be opened satisfactorily by the consumer. At present, these requirements can only be met by axially long portions and thus by using large quantities of material, cf. in this respect WO 2010/136414 Al (Crown), Par. [26] and WO 2012/158937 (Stacked Wines).

SUMMARY OF THE INVENTION

The object of the invention is to reduce the use of metal, glass and plastics in the production of the closure cover, the closed closure unit (container and cover) and in the associated processes, without allowing the quality and benefits to the consumer to suffer as a result.

This has been achieved with a surprisingly low height-width ratio of the closure cover, which has also provided a reduction in the amount of the raw glass material which is used. Thus, the aforementioned object is achieved by a closure cover which consists of sheet metal. It is suitable for a plastics or glass container and is also mechanically configured therefor and adapted thereto. The glass container has outer, circumferentially offset threaded elements which replace a continuous thread, but are arranged in a staggered manner over the circumference. These threaded elements are arranged on a container neck of the container body to which the closure cover (also "metal" closure cover) is to be allocated. This allocation is made in accordance with the PT concept, in which the cover is firstly pressed on axially (p component), and is removed by the user, as the customer (or consumer), by a twisting movement (t component).

The closure cover is to be pressed axially onto the container neck and over the threaded elements. Said cover is adapted to and configured for this purpose, the closure cover having a plastics layer which, on the inside of the cover, rests on a circumferential transition zone and on the skirt portion, more specifically resting thereon in a stable adhesive manner. This plastics layer has an axial extent and a radial extent.

Said transition zone is oriented peripherally and joins the central region of the closure cover (generally known as a "panel") to the axially downwardly projecting skirt portion. Said skirt portion leads into a roll-up region which can have an inner roll-up or an outer roll-up.

By means of a screwing procedure by the consumer, the closure cover is released again from the container neck and from the threaded elements. This releasing movement must be simple, i.e. older people and children must also be able to do it, and this is contrary to the desire for the provision of proper tightness and long preservability in the closed state. The two functions are part of a very difficult coordination process which has to be carried out between correct sealing (pressing axially right down and thus long axial portions on the glass neck and on the closure cover) and simple twisting to break (in the sense of overcoming) the vacuum, which forms after cooling, in the closed container.

This axial force, transmitted by means of threaded elements, on the compound is adapted very precisely and must be coordinated; if this force is too low, the cover remains underneath and cannot be unscrewed in the axial direction (by the twisting movement). If the adhesion of the compound to the threaded elements is too weak, the retention is inadequate for sealing during transportation, during storage and while offered for sale on the shelf and also in the event of temperature fluctuations. If the force is too high, the closure cannot be easily opened. Furthermore, the vacuum in the container must be considered and it influences said forces.

The claimed closure unit consists of a glass container with outer, circumferentially offset threaded elements on a container neck of the glass container. Associated therewith, a sheet metal closure cover is provided, said closure cover having on the inside of the cover an encircling plastics layer which is arranged thereon in a sealing and retaining manner and also acts in said manner. The closure cover is (or was) pressed onto the container neck and can be opened by a twisting movement via the threaded elements and a vertical portion of the plastics layer. This outlines the technical/structural configuration thereof, and thus also the container neck of the also claimed glass container. The claimed state is the closed state after the closure cover has been pressed onto the container neck.

The container neck has a horizontally oriented "surface" (as the upwardly directed end face), on which a horizontal portion of the plastics layer rests on the closure cover in a pressurised sealing manner.

The closure cover has a central region, an adjoining, circumferentially oriented transition zone and an axially downwardly projecting skirt portion which leads into a roll-up region. The plastics layer is arranged such that it adheres to the transition zone and to the skirt portion on the inside of the cover. An axial extent of the skirt portion and a radial measurement of the horizontally oriented end face of the container neck form a first ratio, called $v_1$, which is less than 3.00. This provides the surprising effect that in spite of a relatively short skirt portion, an adequate surface is available to permanently seal the closed combination of closure cover and glass container (at least up to MHD), although the shortening is also accompanied by a reduction in the effective sealing surface. Nevertheless, enough lifting force, which is formed as an axially directed lifting-off force as a result of twisting, can be generated when twisting the closure cover, and the twisting force, i.e. the releasing torque is not too great and can also be achieved or applied by older people, measured in inch*lbs or Nm, and in the usable range of less than 50 inch*lbs, preferably 35 inch*lbs, at 70 mm (diameter) closures and 180 mbar to 300 mbar (18 kPa to 30 kPa) vacuum, corresponding to less than 5.64 Nm, preferably 3.95 Nm.

The separately claimed cover is also able to achieve this combined object in that it implements a ratio of two functional elements which is defined as follows: an axial extent of the skirt portion and a radial extent of the transition zone form a (second) ratio, called $v_2$, which is less than 1.00. This provides the surprising effect that in spite of a relatively short skirt portion, a (still) adequate surface is available to permanently seal the closed combination of closure cover and plastics container or glass container. At the same time, enough lifting force, which is formed as an axially directed lifting-off force as a result of twisting, can be generated when twisting the closure cover, and the twisting force, i.e. the releasing torque is not too great and can also be achieved or applied by older people.

Due to a shortening of the skirt portion, it would seem to a person skilled in the art that a force is generated which is too low and a sealing zone exists in the axial direction which is too short, although this has surprisingly not been confirmed in tests. In fact, these tests have very surprisingly shown that, in contrast to the longstanding prior art and long-time experience, an axially short configuration of the skirt portion, which is shorter than the radial extent of the transition zone in which the radially directed portion of the plastics layer (generally called "compound") is located, also provides a satisfactory seal and an adequate axially directed lift-off force.

Consequently, compound and sheet metal is saved due to the relatively short axial skirt, and a saving is made in the raw material for the associated correspondingly shorter opening portion of the plastics or glass container which are also shorter or can be shortened in the axial direction compared with the prior art.

The radially oriented portion of the plastics layer presses in the same way, in an accurately functioning and reliable manner on the upper end face of an opening region of the container. After the closure cover has been pressed on, this opening region or the upper end face is pressed slightly further into the plastics layer, thereby providing not only pure contact, but also sealing pressurised closure.

In other words, the claimed ratio states that the radial extent, responsible for the axial sealing, of the transition zone is greater than the axial length of the skirt portion. The skirt portion means a straight, cylindrical portion of the closure cover which can have a roll at the lower end thereof. This can be an inner roll-up or an outer roll-up which adjoins the skirt portion—directly adjoining in the case of the outer roll-up or with a widening transition portion placed therebetween in the case of the inner roll-up.

It can be understood that the transition zone, which receives its name from the transition between the panel (cover panel) and the axial skirt (skirt portion), also has curved elements. Thus, a radially outer end portion of the transition region is a 90° curved arc in order for it to lead into the continuously straight skirt portion.

If an inner roll-up region is arranged at the lower end of the skirt portion, which runs in a continuous straight line and does not have any mechanical beads or threaded elements, there is a transition region between this inwardly extending roll-up region (directed radially inwards) and the lower end of the straight skirt portion. This transition region makes a widening in the radial direction so that the adjoining, inwardly directed roll-up receives adequate space, formed by distancing, outside the container wall (the lower end of the opening region).

In a preferred embodiment, the roll-up region (outer roll or inner roll) has at least a 360° roll. An arc is preferably provided in the outer curvature region of the transition zone of the closure cover so that the preferably straight, axially downwardly projecting skirt portion extends between said arc and the roll.

It should be noted that the term "roll-up" does not mean that it is an inwardly directed roll-up, but this terminology also claims an outwardly directed roll-up.

In a preferred embodiment, said ratio of the axial extent of the skirt portion and of the radial extent of the transition zone is greater than 0.85 and is thus less than 1.0. In further preferred embodiments, the outer roll-up and the inner roll-up "playing a role", based on particularly preferred ranges of the second ratio. The ratio for the inner roll-up is preferably 0.9 with a deviation range of ±5%, in particular 0.89 with a more precisely specified second ratio of 0.89 with a deviation range or tolerance band of ±1%. These more precise tolerance ranges or catchment areas are to replace the "substantially" terms which are presently difficult to achieve legally, and are thus to be understood analogously.

In the case of the outer roll-up, the ratio is preferably within the region of 0.98 which has a catchment area or range of protection of ±2% hat, and so a person skilled in the art can also understand analogously here that the second ratio is substantially 0.98. This is preferred in the case of the outer roll-up, which does not have a bell-shaped widening after the axially extending skirt portion, as is preferably the case for the inner roll-up.

Associated with the press-on/twist-off closure, a container having an end portion is provided which has at least two, but preferably many threaded segments which extend circumferentially (and at an angle) thereon. Due to their plurality, these inclined threaded segments are arranged such that they are directed outwards, in a manner interlaced or staggered with respect to one another around the circumference of the container opening.

The closure cover is pressed on axially, i.e. it is pressed axially over the threaded segments by a pressing force, the threaded segments being pressed into the resilient plastics layer due to their rigidity. This ensures that during a subsequent untwisting action, the segments in the impressed paths lift the closure cover axially upwards during a twisting movement. As long as this torque does not arise, the pressed-on closure cover remains positioned on the end portion of the container (on the opening region) so that the axial portion of the plastics layer arranged on the cover side on the transition zone and on the skirt portion comes into axially blocking contact with the threaded segments of the container.

In a method for releasing the sheet metal cover from the container arrangement, the threaded segments are guided circumferentially in order to raise the sheet metal cover axially and to release it from the threaded segments, as a result of which the packaging consisting of closure cover and container is opened.

In one embodiment, a comparable closure method in which the glass container is also closed and it has an end portion with many threaded segments extending in a circumferentially offset manner thereon is disclosed. The closure cover is configured such that it has the described skirt portion and the described transition zone. The radially directed transition zone forms the comparison standard, the axially extending skirt portion being adapted in magnitude to the measurement of the radially directed extent (or to the radial measurement of the transition zone). This claimed magnitude encompasses a range of the ratio of between 0.8 and 1.1, thus is not the "physical magnitude", but is analogously a size approximation which differs significantly from the prior art because the axial skirt portion in the prior art is considerably longer or greater than the radially extending transition zone.

A comparison with the prior art of a current closure cover will demonstrate this.

The axial length of the skirt portion is approximately 6.5 mm, and the radially directed transition zone is approximately 4.6 mm, and so a ratio is formed which is not to be covered by the idea of adapting the magnitude, i.e. is a factor of approximately 1.4, whereas a ratio of at most 1.1 is claimed for the substantially shorter axially directed skirt portion.

The ratio of the axial extent of the skirt portion in reference to a radial measurement of the horizontally oriented end face provides a very compact closure region in the closure unit. In this respect, a measurement of the metal closure cover is related to an end-face measurement of the glass container. One is oriented axially, the other radially. To form the horizontal end face, an imaginary plane can be added which also allows a measurement of the axially upper end of the threaded elements (=threaded segments). The thus definable axial distance has a measurement which is less than 2.0 mm or even less. This represents an axial portion of the container neck which is significantly shorter than the prior art, no threaded elements being provided on this portion. The threaded elements are arranged on a portion located axially further below, and so they are not omitted.

This is described with a horizontal plane which runs through the horizontally oriented end face of the container neck. Measured from there to the upper end of the plurality of circumferentially offset threaded elements, it is only "a short distance", in any case less than 2.0 mm, preferably less than or equal to 1.6 mm and more preferably less than or equal to 1.3 mm.

It is obvious that this portion, which is intended for an additional seal in the prior art, can be omitted without impairing the effectively obtained sealing effect, and consequently the material costs in respect of glass, compound and sheet metal are reduced.

The radially outer end portion of the transition region can have a 90° curved arc. The arc merges directly into the straight skirt portion. To clarify the terms of horizontal extent and vertical extent or axial extent, the axially straight skirt portion stands perpendicularly on the plane in which the central region of the closure cover is located.

There are two variants for the roll-up on the lower edge of the skirt portion, the outer roll and the inner roll. A "roll" is to be understood as a substantially circular formation. If this circular formation is an outer roll-up, it directly adjoins the straight skirt portion. If the roll-up is an inner roll-up, there is a transition region, which produces a widening of the radial measurement of the skirt, located between the straight skirt portion and the inner roll-up. In the case of this inner roll-up, the first ratio is preferably such that it is less than 2.70.

Another description of the press-on/twist-off closure describes the central region as a metal plate. Projecting downwards from this is a metal skirt, the plate together with the skirt describing and defining a generally cylindrical inner recess. The metal skirt runs in a continuous straight line, ending in a roll portion. In this closure cover as well, the axial shortness of the skirt is described by a ratio. An axial length of the metal skirt is shorter than a radial extent of a transition zone between the upper end of the metal skirt and a radially outer end of the metal plate. This includes the fact that the course of this transition zone does not have to be linearly radial, but that the sheet metal can define in this transition zone a depression which can have a plurality of radii of curvature and one or more inclined portions. When the cover is twisted, the transition zone acts like a type of channel to receive a radial portion of a compound. The axial portion of this compound extends on the inside of the cylindrically formed skirt and also forms, in addition to a sealing function, the retaining function and screwing function of the PT concept. The compound is preferably a PVC compound or a TPE compound.

The roll-up can be directed outwards or inwards, adjoining the metal skirt; in the case of an inner roll-up, the metal skirt is bell-shaped in the lower end region, there being three portions, a cylindrical portion, the widening bell-shaped portion and thereafter the inner roll-up. It is different for the outer roll-up which is arranged directly on the lower end of the cylindrical portion of the skirt, without an intermediate portion being positioned therebetween.

The method for closing the container arrangement comprises steps of claim 35, these steps including the shaping of the closure cover. The container is provided and has an end portion with at least two, preferably a plurality of threaded segments running around the circumference thereof. These threaded segments can be arranged such that they are staggered over the circumference, in which case preferably not more than two staggered threaded segments are arranged among one another in the axial direction; generally when a first threaded segment ends with an axially upper end, the next but one threaded segment starts thereafter or shortly thereafter, below the middle threaded segment, which runs further over the circumference in an inclined manner.

The closure cover is pressed on, more specifically onto the end portion of the container, which is frequently also called the opening portion but will here be called the container neck, the plastics layer which rests on the inside of the cover on a transition zone and on the skirt portion coming into an axially blocking contact with the threaded segments.

Embodiments describe and supplement the claimed invention. Examples do not restrict the claims; however they provide disclosure and should not be understood as being a point of disclosure of features which are "essential" to claims that are supposedly to be completed therein.

DESCRIPTION OF PREFERRED EMBODIMENTS

Figure 1:
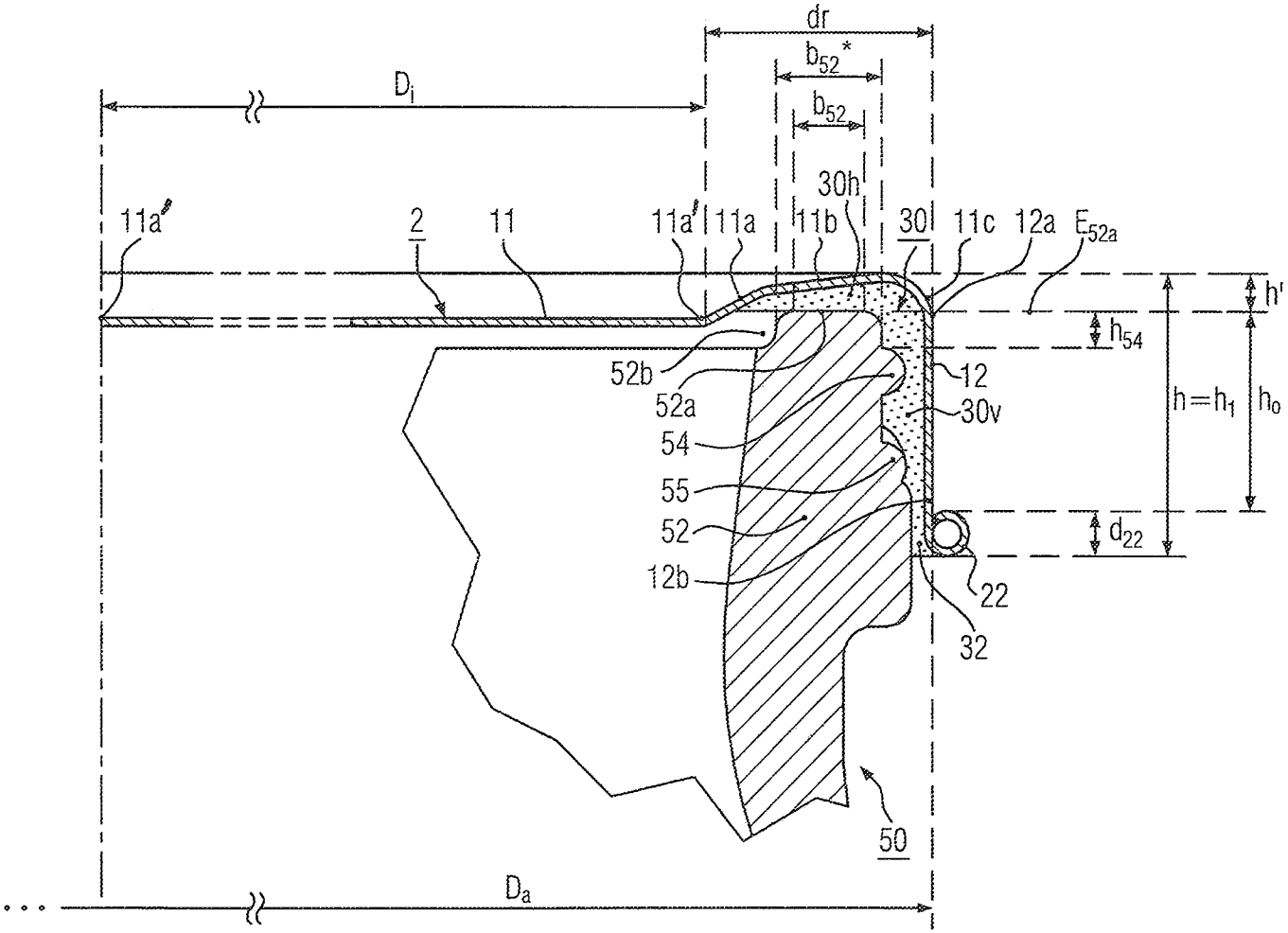
FIG. 1 is a sectional view of a detail of an opening portion of a glass vessel 50 (as container neck) on which a closure cover 2 has been placed. The closure cover is a PT closure cover.

The container 50 preferably consists of glass or rigid plastics. It has an opening region 52 as the container neck, which is shown in FIG. 1 in a detail view and in an enlarged view in FIG. 3. The upper end of the neck 52 of the container 50 is a radially directed end face 52*a*, which is closed inwards by a circumferential fillet groove 52*b* and outwards via an axial length $h_{54}$, which extends as far as the axially upper end of the threaded web 54. Since an axial sectional view is shown, it is clear that this sectional view can apply to every circumferentially further offset, axial sectional view, except for the height position of the two illustrated threaded segments 54, 55, which are in a different height position of the outer surface of the container neck 52, depending on the circumferential twisting of the vertical section. The fitted closure cover 2 is also shown in a detail view, primarily in its retaining region on the opening 52.

Figure 2:
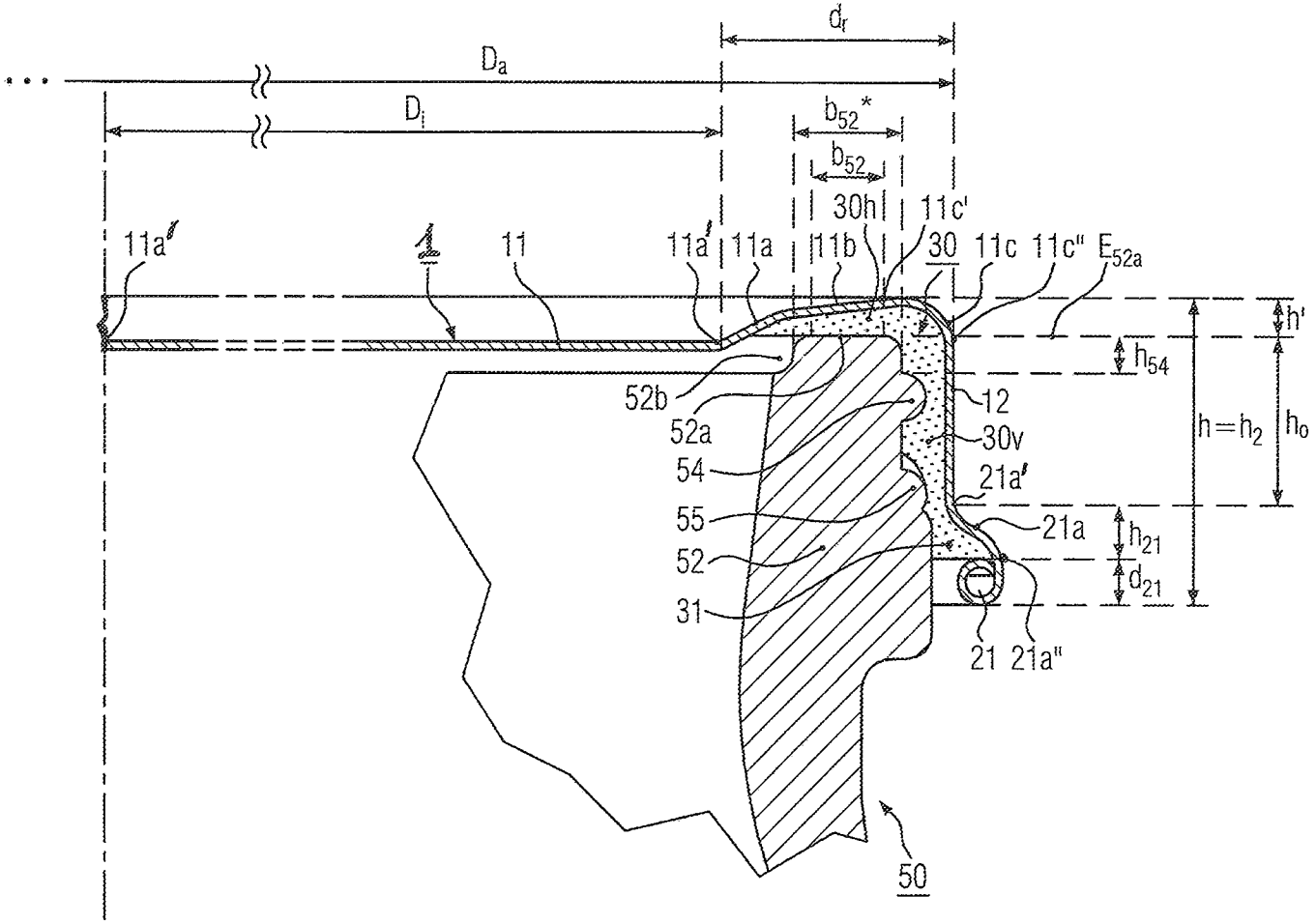
FIG. 2 shows another example of a closure cover 1 in the same detail enlargement.

The same applies in a comparable manner to the closure cover 1 in FIG. 2, where it is also shown in a detail view. Two of its radial measurements are given, $D_i$ and $D_a$.

Measurement $D_i$ is the radial diameter measurement of the cover panel 11, which can also be called the central region. It extends radially inside an encircling bend 11*a*' which leads into the peripheral region represented by reference numerals 11*a*, 11*b* and 11*c*.

The external measurement $D_a$ should firstly be described. It is the diameter measurement of the skirt 12 which adjoins the transition zone 11*a*, 11*b*, 11*c* radially outside, but projects downwards in an axial direction. FIGS. 1 and 2 do not show the left side of the skirt portion 12, and so the start of the external diameter $D_a$ also remains open on the left edge, but the diameter measurement $D_i$ can be shown at the left edge corresponding to the encircling bend line 11*a*'.

The difference between the two diameters $D_a$ and $D_i$ describes the radial measurement dr, as shown in FIGS. 1 and 2, where $D_a-D_i=2dr$.

The measurement dr includes, starting from the encircling bend 11*a*', the first ramp portion 11*a*, a slightly less inclined second ramp portion 11*b* above the end face 52*a* of the neck 52 of the container 50, and the right-hand outer end of this second ramp portion 11*b* merges via a curved portion 11*c* into the skirt portion 12.

The upper end of the skirt portion 12 is 12*a* in FIG. 1, and 12*b* denotes the lower end. The skirt 12 extends axially between these two ends or end points in a straight line and forms a cylinder, viewed in the circumferential direction.

Located under the lower end 12*b* of the skirt portion 12 is an outer roll 22 which is directly adjoined thereto.

Arranged in the radial transition portion of radial width dr is a radially directed, horizontal portion 30*h* of a sealing layer 30, and arranged radially inside the skirt 12 is the axial portion 30*v* of the plastics sealing layer.

The circumferentially running plastics layer consists of these two portions 30*h* and 30*v*, said layer extending in FIG. 1 as far as the roll region 22, radially inside the outer roll 22 where it is denoted by 32. Correspondingly in FIG. 2, portion 31 is above the inner roll 21, radially inside the widening portion 21*a*.

More details are provided below in respect of the measurement. It will firstly be shown that the closure cover 2, pressed on by axial pressure, has not yet been fully pressed on in FIG. 1, because the horizontal portion 30*h* of the plastics layer has not yet been compressed. Said horizontal portion merely rests on the end face 52*a*, but in reality is slightly compressed by the upper end face 52*a* so that the horizontal portion 30*h* of the sealing layer also extends beyond the initial sealing surface 52*a* to regions which can be seen having a radius of curvature (chamfer) on the left and right of FIG. 1. On the left in FIG. 1 or FIG. 2, the radial compound portion 30*h* extends slightly into the inner fillet groove 52*b*. This can be seen in the enlargement of FIG. 3, it being possible to use this FIG. 3 for the embodiments of FIGS. 1 and 2.

Figure 3:
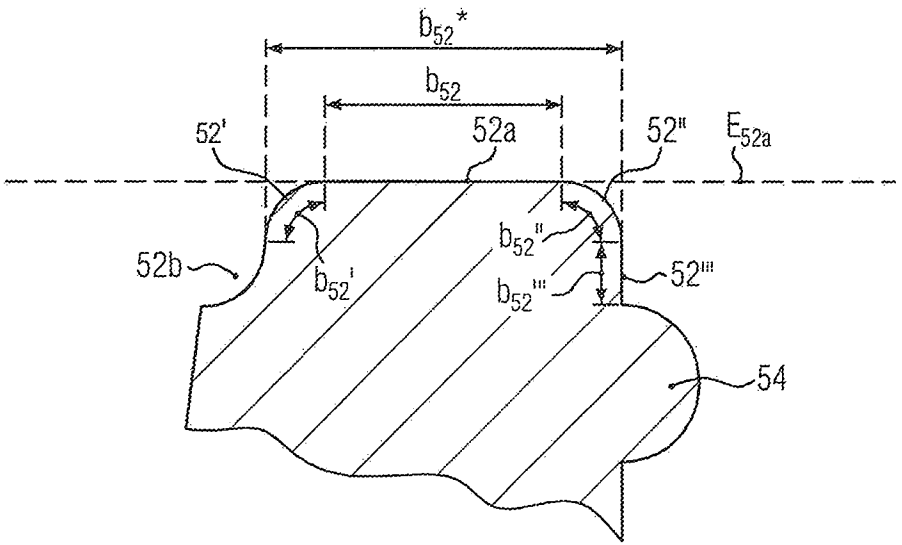
FIG. 3 is a further detail enlargement of the upper end of the opening 52 of the glass container (as container neck), the sealing radially directed end face 52*a* serving as a connecting comprehension element. $b_{52}$* denotes a radial measurement of the effective sealing surface and $b_{52}$ denotes the horizontal end face.

FIG. 3 shows the upper edge of the neck 52. The horizontally oriented, end face 52*a* of width $b_{52}$ may be used as a connecting element. It is oriented purely horizontally and defines a horizontal plane $E_{52a}$, in respect of which absolute dimensions and ratios will be explained in the following.

Located on the left and right of the horizontally oriented end face 52*a* are radii of curvature which fix a curvature 52' and 52". They have an associated length of $b_{52}$' and $b_{52}$".

It should be understood that these surfaces extend circumferentially and that the idea of radial measurement must be considered in a purely radial manner. The length $b_{52}$' lengthens for example the pure radial measurement, and must therefore be added to the radial measurement $b_{52}$ on the inside. $b_{52}$' extends as far as the turning point of the fillet groove 52*b*. Accordingly radially outside with $b_{52}$".

It is possible to see on the outside another axially extending portion 52''' which runs as far as the threaded segment 54. In the example of FIG. 3, this measurement is very short, compared to the curved measurement 52", which has the actual length $b_{52}$", but only a very much smaller radial measurement which is added to the purely radial measurement $b_{52}$, when viewing the entire extending sealing surface which has a purely radial measurement of $b_{52}$*.

This is the radial measurement of the effective sealing surface, which can itself be much longer. Thus, the purely horizontal and purely radially extending end face 52*a* is measured more precisely with the purely radial measurement $b_{52}$.

The sum of the surface portions $b_{52}$, $b_{52'}$, $b_{52''}$ and $b_{52'''}$ is decisive for the seal, the portion 52''' extending practically purely axially and also being oriented slightly radially with a very low inclination angle. The latter portion 52''' ends at the threaded webs, here for the measurement at the upper end of the, or of all of the circumferentially extending threaded webs 54, 55, also of others which are not shown.

In the following, understanding of FIG. 3 is to be carried over to FIGS. 1 and 2, although the inner roll-up will be explained first of all using the example of FIG. 2.

This inner roll-up 21 adjoins the skirt portion 12, with the same elements and functions used as described in FIG. 1. The associated reference numerals are also the same.

The lower axial end of the cylindrical skirt portion 12 does not lead directly into a roll, but into a widening portion 21*a*. The upper end 21' thereof starts at the lower end of the cylindrical portion 12. The widening portion 21*a* merges by its lower end 21*a*" into an inwardly rolled-up portion 21 which describes a 360° roll. Designating the diameter as $d_{21}$ can describe the roll 21 and the height $h_{21}$ describes the height of the transition portion 21*a* which is used for the radial widening and the creation of space or room for the inner roll-up.

Provided radially inside the widening 21*a* is a region 31 of the plastics layer which also extends under the axial lower end 12*b* in FIG. 1, and in FIG. 2 widens radially, but does not extend axially downwards over the inner roll-up, but remains restricted to the height $h_{21}$. Accordingly, the height portion $d_{22}$ of the outer roll 22 of FIG. 1 can be used, which portion defines a comparable plastics portion 32.

Knowledge of FIG. 3 will now be carried over to FIGS. 1 and 2.

Here in FIG. 1, the radial measurement of the end face 52*a* is denoted by $b_{52}$. The effective sealing surface is wider and also longer particularly in the radial direction, yet does not have a measurement corresponding to its real "length", but rather the measurement $b_{52}$* which is shown. These two measurements have been explained in FIG. 3 and are shown respectively in FIGS. 1 and 2, specifically under the second ramp portion 11*b* located above the end face 52*a* which is effective in terms of initial sealing.

The radial measurement dr of the transition zone, consisting of the three elements 11*a*, 11*b*, 11*c* is shown in FIGS. 1 and 2. It is greater than the axial height of the cylindrical skirt portion 12. This height is denoted by $h_0$; it starts at the upper end 12*a* of the skirt portion 12 which corresponds to the radial outer end 11*c*" of the curved arc 11*c*. The inner end 11*c*' of the curved arc 11*c* merges into the second ramp portion 11*b*. It is located approximately at the height of the outer surface of the upper end of the container neck 52 and extends between the upper end of all the threads and a correspondingly imaginary peripheral line (and the plane $E_{52a}$) which describes the position and orientation of the horizontal end face 52*a*, or vice versa.

The measurement and the distance from the plane $E_{52a}$ to the upper end of the threaded segments 54 (and, correspondingly circumferentially offset, of segment 55 as well) is denoted by $h_{54}$. This measurement is particularly short. It ensures that a substantially greater measurement in the prior art of more than 2.8 mm can be significantly shortened in the embodiments of FIGS. 1 and 2. This distance $h_{54}$ is to be designated as a threadless zone between the end face 52*a* and the threaded region of the closer circumferentially offset threaded elements 54, 55.

In the embodiments, this height measurement $h_{54}$ is in any case less than 2 mm. preferably less than 1.6 mm or even substantially 1.3 mm, which shall describe the "very short" extent in the axial direction. This is a significantly shorter axial portion of the container neck which does not have any threaded elements and to which the prior art attributed a significant contribution for the sealing effect. Although these threaded elements are no longer present according to the embodiments of the invention, the embodiments still provide a satisfactory sealing effect.

Another measurement is the radial measurement dr in relation to the described axial height $h_0$ of the skirt portion 12. Here, these two measurements are of the same magnitude, or the height measurement becomes smaller than the radial measurement.

The radial extent is decisive for the sealing effect on the end face of the opening. The axial measurement is decisive for the opening mechanics.

This radial measurement can be the radial measurement dr of the sheet metal cover, consisting of the three portions 11*a*, 11*b*, 11*c* in the transition zone, or it can be the above-described radial measurement 52*a* on the glass which produces the initial sealing contact and defines the plane $E_{52a}$. Radial measurement 52*a* is on the container, radial measurement dr is on the closure cover.

The ratios are such that in an example of the outer roll 22 of FIG. 1, the height measurement $h_0$ can be given as 4.405 mm which, with a cover of an external measurement of 60 mm, is to be related to a dr of 4.48 mm. A ratio $v_2$ of axial height of the skirt to radial extent of the transition zone of 0.98 is produced.

This ratio $v_2$=0.98 to identify an axially very short skirt 12 can have a catchment area of ±2%.

It is to be expected that other diameters of closure covers, not only those of 60 mm, will also have these ratios, because the sealing zone to the axial retaining zone also remains practically unchanged for closure covers of a smaller and greater diameter.

The corresponding dimensioning and fixing of the allocation can also be carried out in respect of the radial measurement $b_{52}$. Here, the outer roll 22 according to FIG. 1 has an axial height measurement of the skirt 12 of $h_0$=4.405, as stated above. The used measurement of the container 50 in the neck portion 52 is $b_{52}$=1.5 mm. This relatively narrow measurement is supplemented by the further measurements which are described in FIG. 3 and which describe the effective sealing surface, and so the radial measurement of the effective sealing surface is given as $b_{52}$*, amounting to 2.35 mm. Within this measurement $b_{52}$*, the pure radial measurement of the end face 52*a* only measures 1.5 mm.

In the example of FIG. 1, the ratio $v_1$ of axial height to the pure radial measurement $b_{52}$ is thus calculated with outer roll from the above values at 2.94, and is less than 3.00. The comparable ratio for the inner roll according to FIG. 2 is that of the height measurement $h_0$ to the extent $b_{52}$ of the end face 52*a*. Here, the measurement $b_{52}$ is equal to that of the example of FIG. 1 and is 1.5 mm.

For the configuration of the inner roll-up 21 according to FIG. 2, a relatively short skirt portion 12 can also be described by ratios, by the first ratio $v_1$ and by the second ratio $v_2$, or by a combination thereof. The first ratio $v_1$ describes the ratio to the end face 52*a* on the glass vessel and the second ratio $v_2$ describes the ratio to the radial extent dr of the transition zone 11*a*, 11*b*, 11*c* alone on the closure cover.

For the closure cover, here as well the axial portion $h_0$ is shorter than the radial measurement dr, and in the example, the height $h_0$ is given as 4.005 mm for FIG. 2 and the radial extent dr is given as 4.48 mm, as in the example of FIG. 1.

This produces a ratio $v_2$ of 0.89, thus smaller than the ratio $v_2$ described with reference to the example of FIG. 1.

This ratio can be stated within a relatively great tolerance range (catchment area) of 0.9±5% just as over 0.89±1%, shown using the example of a 59 mm closure cover in FIG. 2, which diameter measurement $D_a$ is, however, of no significance for the described ratio, since this ratio in the opening region of the closed container 50 remains practically the same irrespective of the diameter of different closures.

An upper limit can be stated which results in this second ratio $v_2$ being less than 1, but a lower limit can also be stated such that the ratio should be greater than 0.85 which, in the case of a technical-functional limitation, should always be described by an upper and a lower limit, while primarily the upper limit is crucial for a distinction from the prior art, as it is best able to describe the small measurement of the axial extent of the skirt 12.

In the example of FIG. 1, the ratio $v_1$ of axial height to the pure radial measurement $b_{52}$ with outer roll is thus 2.94 and is less than 3.00. The other ratio for the inner roll according to FIG. 2 is that of the height measurement $h_0$ to the extent $b_{52}$ of the end face 52*a*. Here, the measurement $b_{52}$ is the same as that of the example of FIG. 1 and is 1.5 mm.

Here, the radial measurement of the effective sealing surface $b_{52}$* is also given as 2.35 mm—remaining the same. This is obvious because both glasses 50 are to be assumed as being the same, in one instance closed with a closure cover 2 with an outer roll 22 and in the other closed with a closure cover 1 with an inner roll 21, in each case at the lower end of the skirt portion 12.

Due to the lower height of 4.005 mm with the axial skirt portion 12, a smaller first ratio $v_1$ of 2.67 is produced. This is also below the upper limit of 3.0 and, specified more precisely, can be stated as being below 2.70.

In the examples of FIGS. 1 and 2, other height measurements are shown which result from the described height measurements.

The height measurement $h=h_2$ for the outer roll 22 according to FIG. 1 is composed of three components, the diameter $d_{22}$ of roll 22, the axial height $h_0$ of the "short" skirt portion 12 and an axial height h' of the transition zone 11*a*, 11*b* and 11*c*, which has the radial width dr. This produces the overall height of the peripheral region of the closure cover 2 for $h_2$.

There is a further component $h_{21}$ in FIG. 2 in the closure cover 1 with an inner roll 21, in addition to the three described components from FIG. 1, here to form the height measurement $h=h_1$. The three components are the same, the axial measurement $h_0$ of the skirt 12, the diameter $d_{21}$ of the inner roll 21 and the axial height measurement h' of the transition zone 11*a*, 11*b*, 11*c*, which can be carried over from FIG. 1. Measurement $h_{21}$ is the axial height of the intermediate portion 21*a*, widened in the shape of a bell, by its lower end 21*a*".

What is claimed is:

1. A closure unit consisting of a glass or plastic container (50) with outer, circumferentially offset threaded elements (54, 55) on a container neck (52) of the container and a closure cover consisting of sheet metal, wherein the closure cover (1, 2) has on the inside of the cover an encircling plastics layer (30; 30*h*, 30*v*) which is arranged and also acts in a sealing and retaining manner; wherein the closure cover:

is pressed onto the container neck (52) and can be opened by a twisting movement via the threaded elements (54, 55) and via a vertical portion (30*v*) of the plastics layer;

the container neck (52) has a horizontally-oriented end face (52*a*) on which a horizontal portion (30*h*) of the plastics layer rests in a pressurised sealing manner;

and the closure cover further comprises:

a central region (11) with an adjoining, circumferentially oriented transition zone (11*a*, 11*b*, 11*c*) and an axially downwardly projecting skirt portion (12) which leads into a roll-up region (21*a*, 21; 22);

wherein the plastics layer (30; 30*h*, 30*v*) is arranged such that it adheres to the transition zone (11*a*, 11*b*, 11*c*) and to the skirt portion (12) on the inside of the cover;

wherein an axial extent ($h_0$) of the skirt portion (12) and a radial measurement ($b_{52}$) of the horizontally oriented end face (52*a*) of the container neck (52) form a first ratio ($v_1$) which is less than 3.00;

and an axial distance ($h_{54}$) of axially upper ends of the circumferentially offset threaded elements from a horizontal plane ($E_{52a}$) through the horizontally oriented end face of the container neck (52) of the container (50) is less than 2.0 mm.

2. The closure unit according to claim 1, wherein a radially outer end portion (11*c*) of the transition region is a 90° curved arc (11*c*), the radially outer end of which merges into a continuously straight skirt portion (12) which is perpendicular to a plane of the central region (11).

3. The closure unit according to claim 1, wherein the roll-up region (22) is an outer roll which directly adjoins the skirt portion (12).

4. The closure unit according to claim 3, wherein the roll-up region (22) has at least a 360° roll.

5. The closure unit according to claim 1, wherein the roll-up region (21*a*, 21) has a lower transition region (21*a*) which is widened outwards and adjoins a lower end of the skirt portion (12) and an inner roll (21) adjoins the end of the widening.

6. The closure unit according to claim 5, wherein the skirt portion (12) extends in a continuous straight line between a lower end (11*c*") of an outer arc (11*c*) and the upper end of the transition region (21*a*), and the first ratio ($v_1$) is less than 2.70.

7. The closure unit according to claim 1, wherein the axially downwardly projecting skirt portion (12) extends in a continuous straight line.

8. The closure unit according to claim 1, wherein the roll-up region (21*a*, 21; 22) has an inner roll-up (21) or an outer roll-up (22).

9. The closure unit according to claim 1, wherein an axial extent ($h_0$) of the skirt portion (12) of the closure cover and a radial extent (dr) of the transition zone (11*a*, 11*b*, 11*c*) form a second ratio ($v_2$) which is less than 1.00.

10. The closure unit according to claim 1, wherein the axial distance ($h_{54}$) of the axially upper ends of the circumferentially offset threaded elements (54) is less than or equal to 1.6 mm.

11. The closure unit according to claim 1, wherein the axial distance ($h_{54}$) is less than or equal to 1.3 mm, corresponding to a significantly shortened axial portion of the container neck (52) without threaded elements.

* * * * *